US005273247A

United States Patent [19]

Jan

[11] Patent Number: 5,273,247

[45] Date of Patent: Dec. 28, 1993

[54] ADJUSTABLE BOOK STAND

[76] Inventor: Rong S. Jan, No. 672-11, Per-Ser-Wei, Pei-Hu-Li, Chia Yi City, Taiwan

[21] Appl. No.: 970,789

[22] Filed: Nov. 3, 1992

[51] Int. Cl.[5] ..... A47B 19/00

[52] U.S. Cl. ..... 248/441.1; 312/233

[58] Field of Search ..... 248/447, 441.1, 445, 248/447.1, 447.2, 454, 455, 456; 312/234, 237, 233.1, 233; 108/123, 50, 60

[56] References Cited

U.S. PATENT DOCUMENTS

| | | | |
|---|---|---|---|
| 279,004 | 6/1883 | Pardue | 312/233 |
| 1,483,051 | 2/1924 | Saunders | 248/441.1 |
| 2,239,322 | 4/1941 | Heymans | 312/233 |
| 2,388,353 | 11/1945 | Watson | 312/233 X |
| 3,199,825 | 8/1965 | Bellows | 248/456 X |
| 5,174,223 | 12/1992 | Nagy | 108/50 |

FOREIGN PATENT DOCUMENTS

| | | | |
|---|---|---|---|
| 1227028 | 8/1960 | France | 248/441.1 |

*Primary Examiner*—J. Franklin Foss

*Attorney, Agent, or Firm*—Jacobson, Price, Holman & Stern

[57] ABSTRACT

A book stand includes a base, a post extended upward from the base, a sleeve slidably engaged on the post and movable up and down along the post, a housing rotatably disposed on the sleeve at a vertical axis, and a board rotatably disposed on the housing at a lateral axis. The height of the board can be adjusted when the sleeve slides along the post, and the angular positions of the board can be adjusted when the housing rotates about the vertical axis and when the board rotates about the lateral axis.

4 Claims, 6 Drawing Sheets

ADJUSTABLE BOOK STAND

BACKGROUND OF THE INVENTION

1. Field of the Invention

The present invention relates to a book stand, and more particularly to an adjustable book stand.

2. Description of the Prior Art

Typical book stands can not be rotated and can not be elevated such that the position of the book stands can not be suitably adjusted to suit the light source.

The present invention has arisen to mitigate and/or obviate the afore-described disadvantages of the conventional book stands.

SUMMARY OF THE INVENTION

The primary objective of the present invention is to provide a book stand which can be rotated and the height of which can be adjusted.

In accordance with one aspect of the present invention, there is provided a book stand comprising a base, a post extended upward from the base, a sleeve slidably engaged on the post, means for moving the sleeve up and down along the post, a housing rotatably disposed on the sleeve at a vertical axis, means for rotating the housing about the vertical axis, a board rotatably disposed on the housing at a lateral axis, and means for rotating the board about the lateral axis in order to adjust the height and the angular positions of the board.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
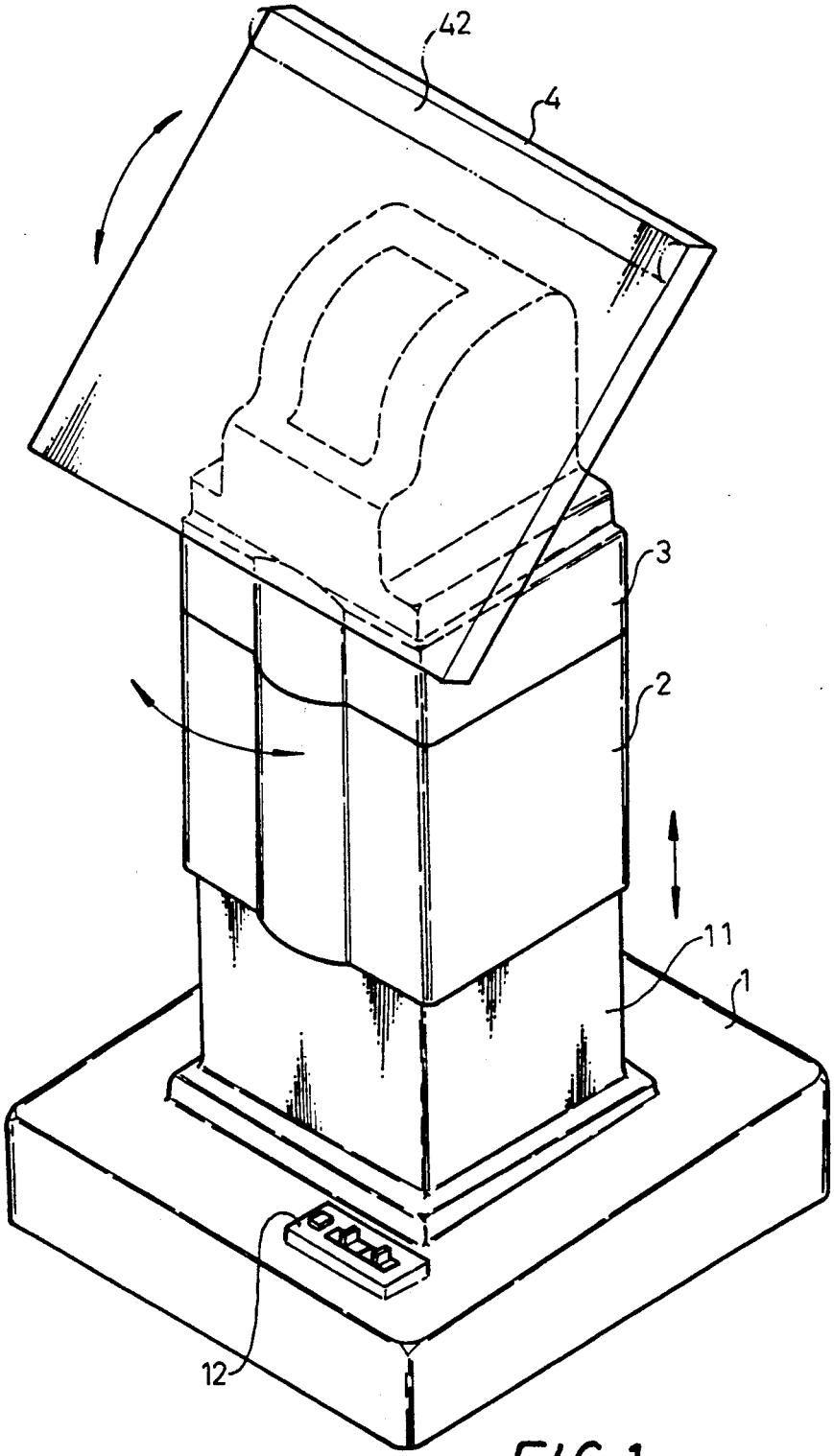
FIG. 1 is a perspective view of a book stand in accordance with the present invention.

Referring to the drawings and initially to FIG. 1, a book stand in accordance with the present invention comprises generally a base 1, a post 11 extended upward from the base 1, a sleeve 2 slidably engaged on the post 11 and movable up and down along the post 11, a housing 3 rotatably disposed on the sleeve 2, and a board 4 rotatably supported on the housing 3 for supporting a book and the like.

Figure 2:
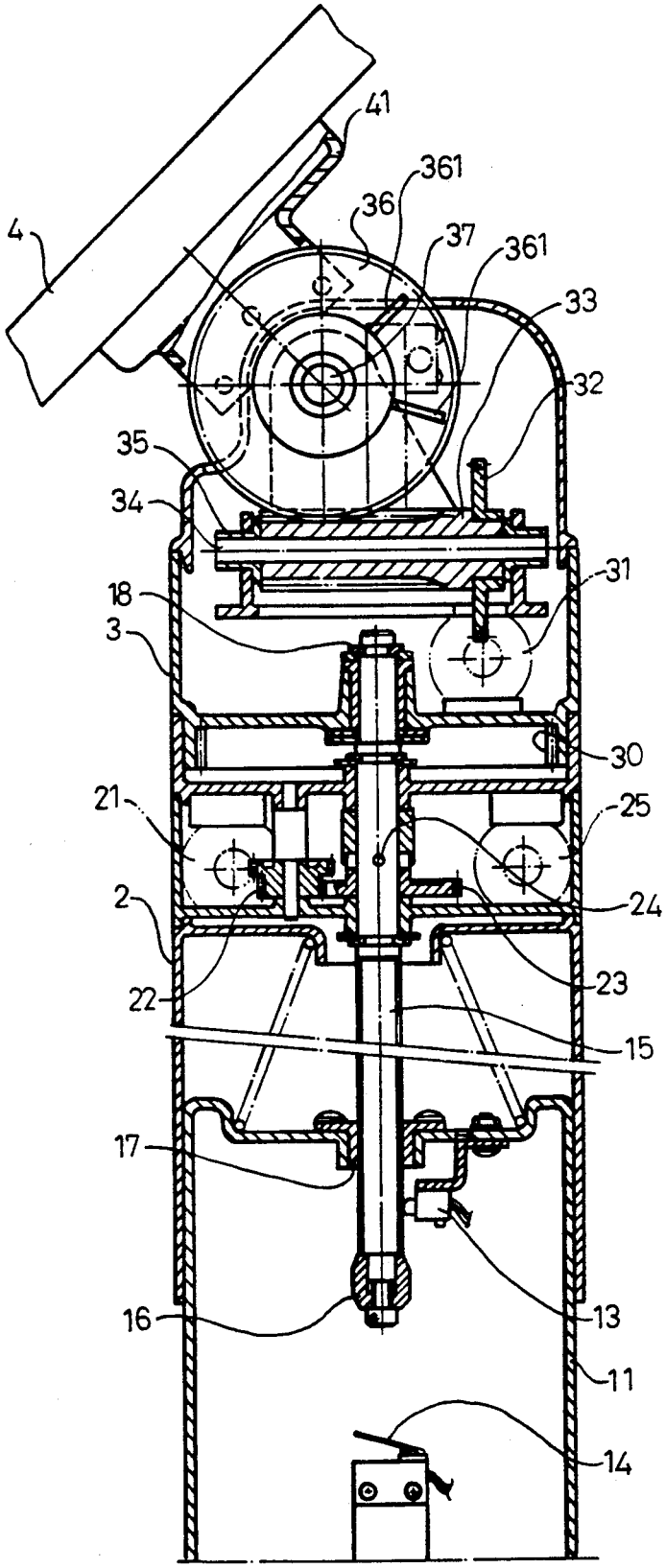
FIG. 2 is a cross sectional view of the book stand.
Figure 3:
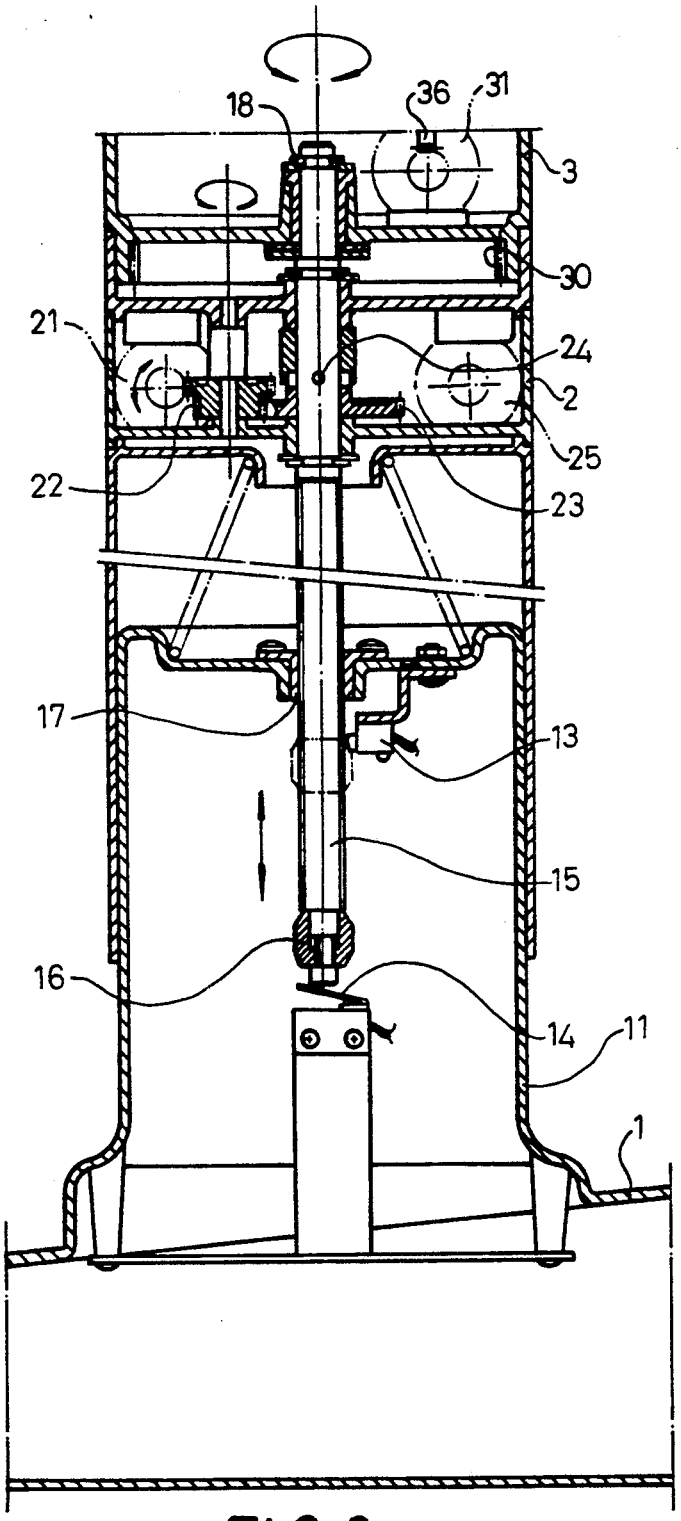
FIG. 3 is a cross sectional view similar to FIG. 2, illustrating the lower portion of the book stand.

Referring next to FIGS. 2 and 3, the post 11 includes a pair of microswitches 13, 14 disposed therein, a stub 17 fixed in the upper portion of the post 11 and having an inner thread formed therein, a bolt 15 threadedly engaged with the inner thread of the stub 17 such that the bolt 15 is movable up and down when the bolt 15 rotates relative to the stub 17, a head 16 formed in the bottom of the bolt 15 and engageable with the microswitches 13, 14 so as to control the rotation and the upward and downward movements of the bolt 15. The middle portion of the bolt 15 is rotatably supported in the sleeve 2 and arranged such that the sleeve 2 and the bolt 15 move upward and downward in concert, a gear 23 is fixed to the bolt 15 by a pin 24 and located in the sleeve, and a motor 21 disposed in the sleeve 2 and engaged with the gear 23 via a pinion 22 so as to drive the gear 23, such that the sleeve 2 can be caused to move up and down relative to the post 11. The motor 21 is stopped when the head 16 of the post 15 actuates either of the microswitches 13, or 14. Another motor 25 is also disposed in the sleeve 2. The upper portion of the bolt 15 is rotatably supported in the lower portion of the housing 3 and retained in place by a C-clamp 18.

Figure 5:
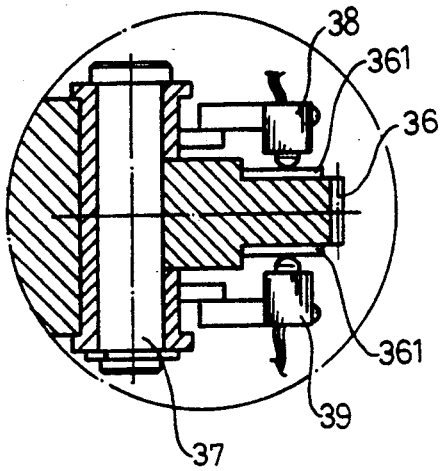
FIG. 5 is partial cross sectional view illustrating the upper portion of the book stand.
Figure 4:
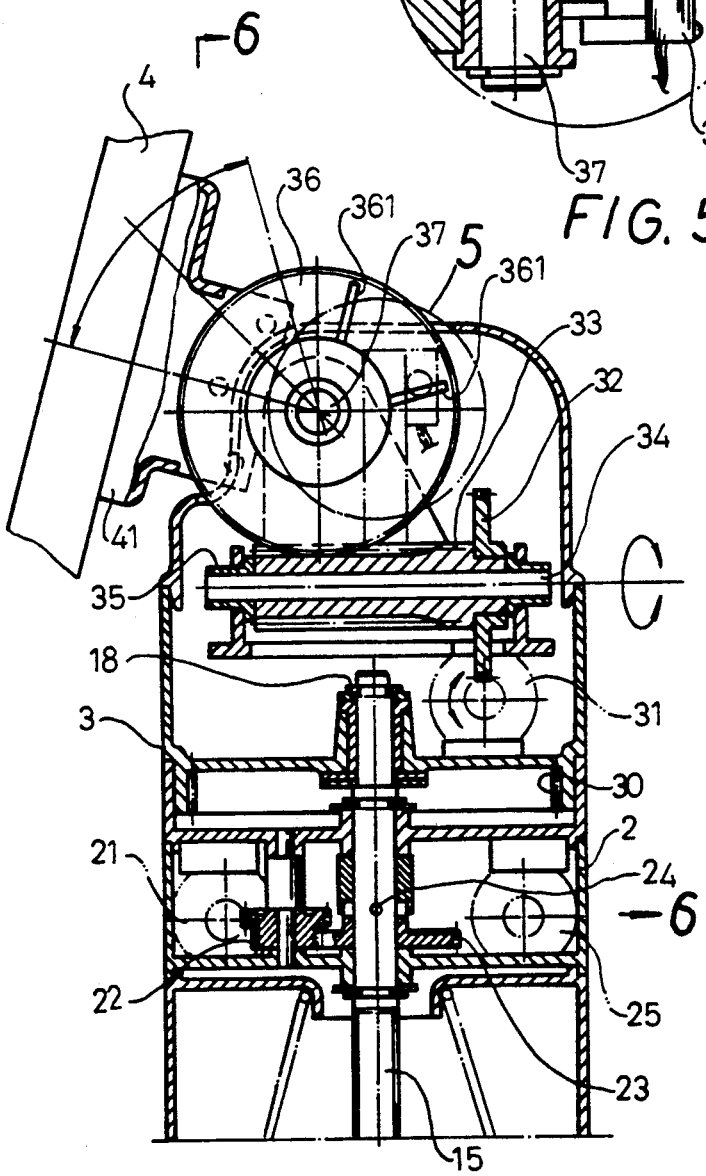
FIG. 4 is a cross sectional view similar to FIG. 2, illustrating the upper portion of the book stand.
Figure 6:
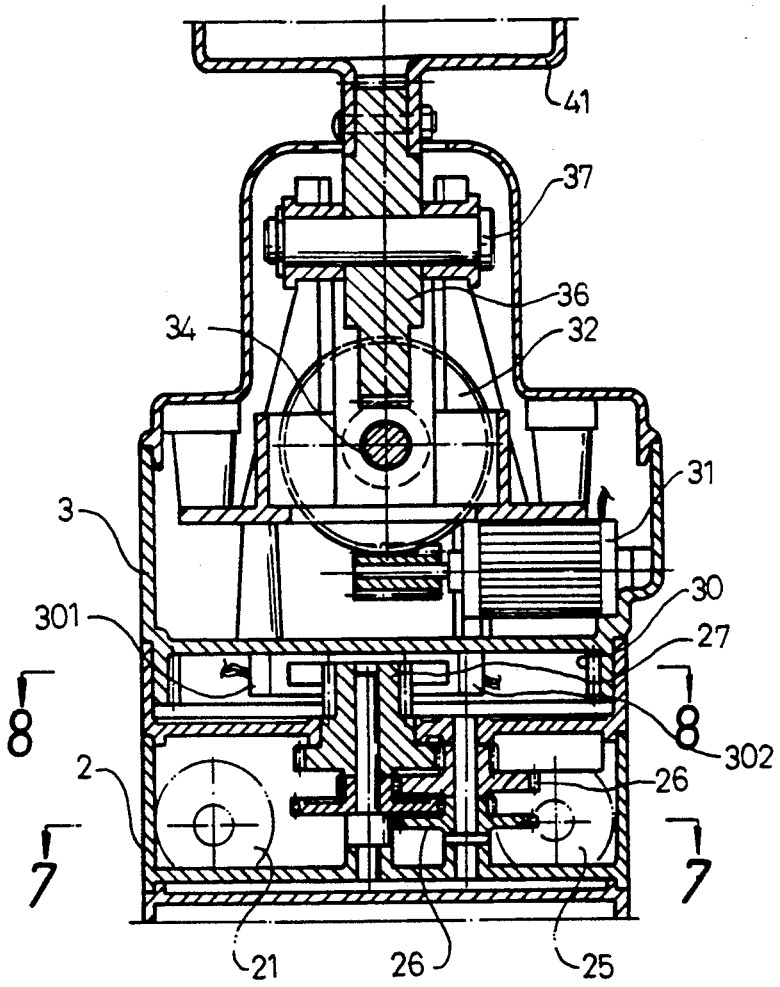
FIG. 6 is a cross sectional view taken along lines 6—6 of FIG. 4.

Referring next to FIGS. 2, 4 and 5, a motor 31 is disposed in the housing 3 and engaged with a gear 32 which is fixed to a warm gear 33, the warm gear 33 is rotatably supported on a spindle 34 which is rotatably supported on a bracket 35, the warm gear 33 is engaged with a gear 36 which is rotatably supported at a lateral axis 37, the gear 36 extends upward beyond the housing 3, the board 4 includes a support 41 which is fixed to the gear 36, such that the board 4 can be rotated about the lateral axis 37 by the motor 31. Two ribs 361 are extended from the gear 36 and engageable with two switches 38, 39 disposed in the housing 3, in order to control the rotation movements of the gear 36.

Figure 7:
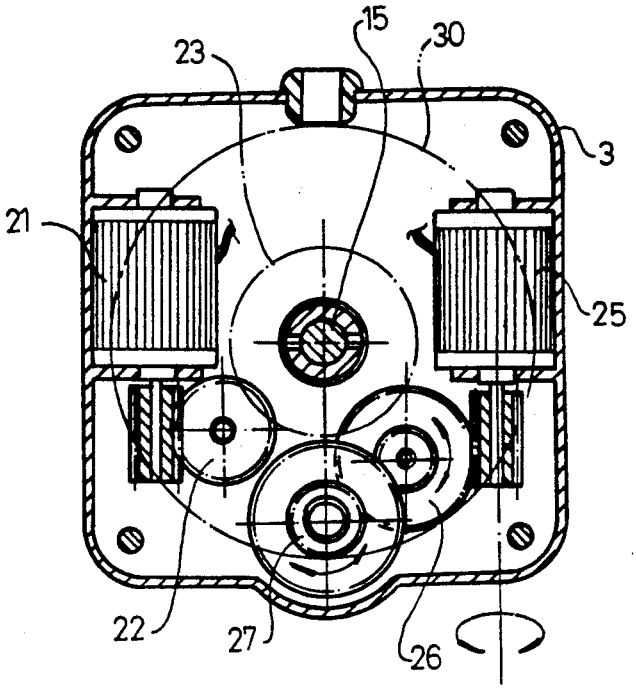
FIGS. 7 and 8 are cross sectional views taken along lines 7—7 and 8—8 of FIG. 6 respectively.
Figure 8:
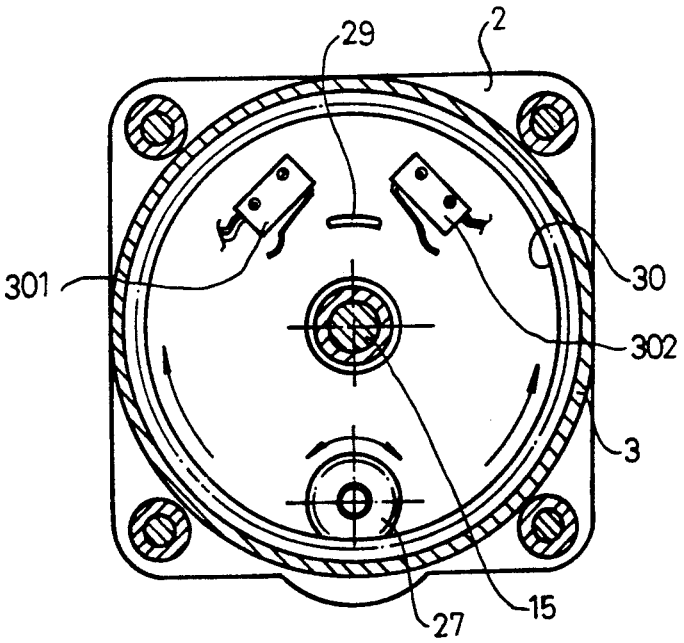

Referring next to FIGS. 2, 6, 7 and 8, a gear wheel 27 is rotatably disposed in the sleeve 2 and coupled to the motor 25 via a gear 26, such that the gear wheel 27 can be rotated by the motor 25; the gear wheel 27 is engaged with the internal gear 30 formed in the inner and lower portion of the housing 3, best shown in FIGS. 7 and 8, such that the housing 3 can be rotated relative to the sleeve 2 by the motor 25 by the engagement between the gear wheel 27 and the internal gear 30. It is to be noted that the housing 3 is rotatable about a vertical axis, i.e., the bolt 15. An extension 29 is extended upward from the sleeve 2, two switches 301, 302 are fixed to the housing 3 and are engageable with the extension 29 so as to control the operations of the motor 25, such that the rotation movements of the housing 3 relative to the sleeve 2 can be controlled.

Accordingly, the book stand in accordance with the present invention includes a board 4 rotatable about a lateral axis 37, and the housing 3 is rotatable about a vertical axis 15, in addition, the sleeve 2 is movable up and down along the post 11, such that the height and the angular positions of the board 4 can be adjusted.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A book stand comprising a base, a post extended upward from the base, a sleeve slidably engaged on said post, moving means for moving said sleeve up and down along said post, a housing disposed on said sleeve for rotation about a vertical axis, a board disposed on said housing for rotation about a lateral axis, and means for rotating said board about said lateral axis in order to adjust the height and the angular positions of said board, wherein said post includes a stub disposed in an upper portion thereof and having an inner thread formed therein, said moving means includes a bolt rotatably engaged with said inner thread of said stub and rotatably supported in said sleeve, said bolt forming said vertical axis, whereby, said bolt and said sleeve are moved up and down along said post when said bolt rotates relative to said stub.

2. A book stand according to claim 1, wherein said bolt includes a gear fixed thereon and located in said sleeve, said sleeve includes a motor disposed therein and engaged with said gear so as to rotate said bolt.

3. A book stand comprising a base, a post extended upward from the base, a sleeve slidably engaged on said post, moving means for moving said sleeve up and down along said post, a housing disposed on said sleeve for rotation about a vertical axis, means for rotating said housing about said vertical axis, a board disposed on said housing for rotation about a lateral axis, and means for rotating said board about said lateral axis in order to adjust the height and the angular positions of said board, wherein said means for rotating said housing includes an internal gear in an inner and lower portion of said housing, a gear wheel rotatably supported in said housing and engaged with said internal gear, and a motor engaged with said gear wheel for rotating said gear wheel and said housing.

4. A book stand, comprising a base, a post extended upward from the base, a sleeve slidably engaged on said post, moving means for moving said sleeve up and down along said post, a housing disposed on said sleeve for rotation about a vertical axis, means for rotating said housing about said vertical axis, a board disposed on said housing for rotation about a lateral axis, and means for rotating said board about said lateral axis in order to adjust the height and the angular positions of said board, wherein said means for rotating said board includes a first gear rotatably supported in said housing at said lateral axis, said board is fixed to said first gear, a worm gear rotatably supported in said housing and engaged with said first gear, and a motor disposed in said housing and engaged with said worm gear so as to rotate said gear, whereby, said board is rotated about said lateral axis.

* * * * *